US006842952B1

(12) United States Patent
Gilbert

(10) Patent No.: US 6,842,952 B1
(45) Date of Patent: Jan. 18, 2005

(54) CHILD SEAT SAFETY STRAP SYSTEM

(76) Inventor: Kevin E. Gilbert, 3613 Kahler Dr. NE., St. Michael, MN (US) 55376

( * ) Notice: Subject to any disclaimer, the term of this patent is extended or adjusted under 35 U.S.C. 154(b) by 0 days.

(21) Appl. No.: 10/440,559

(22) Filed: May 19, 2003

(51) Int. Cl.[7] ..... A44B 11/25

(52) U.S. Cl. ..... 24/629; 24/171; 24/191; 24/170

(58) Field of Search ..... 24/633, 634, 664, 24/629, 265 R, 265 BC, 265 EC, 170, 171, 191, 579.11; 280/801.1, 808, 807; 297/474, 475, 468, 473, 483, 485

(56) References Cited

U.S. PATENT DOCUMENTS 2,885,215 A * 5/1959 Williamson ..... 280/42
3,381,268 A 4/1968 Boblitz
3,542,426 A * 11/1970 Radke ..... 24/579.11
3,600,768 A * 8/1971 Romanzi et al. ..... 24/579.11
3,790,209 A * 2/1974 Littmann ..... 297/483
3,885,811 A * 5/1975 Takada ..... 297/483
4,334,701 A * 6/1982 Takada ..... 297/483
4,624,033 A 11/1986 Orton
4,915,413 A * 4/1990 Meyer ..... 280/801.1
5,260,684 A 11/1993 Metzmaker
5,403,038 A * 4/1995 McFalls ..... 280/808
5,620,231 A 4/1997 Marker et al.
5,810,435 A 9/1998 Surot
6,430,797 B1 8/2002 Dittmar et al.

* cited by examiner

*Primary Examiner*—Robert J. Sandy
(74) *Attorney, Agent, or Firm*—Donald R. Schoonover

(57) ABSTRACT

A strap system can be retrofit onto the backseat of a motor vehicle to securely mount a child safety seat in the backseat of the motor vehicle. The strap system includes a shoulder strap that is mounted on the back support portion of the backseat and a connector element that couples the shoulder strap to one lap belt portion of the seat belt system of the motor vehicle. The connector element is releasably coupled to the seat belt buckle to releasably couple the shoulder strap to the lap belts of the seat belt system of the motor vehicle.

1 Claim, 1 Drawing Sheet

CHILD SEAT SAFETY STRAP SYSTEM

BACKGROUND OF THE INVENTION

1. Field of the Invention

The present invention relates to the general art of motor vehicle accessories, and to the particular field of safety belts.

2. Discussion of the Related Art

Many States have laws directed to how a young child is to be carried in a motor vehicle. Many States require a young child to be strapped into a child safety seat that is securely mounted in the middle of a backseat of the motor vehicle.

Many new cars have accommodations for such a backseat-located child seat. However, some older cars, or imported cars, may not have the equipment required to meet the requirements of such laws. This may require expensive retrofitting or even, in some instances, replacement of the vehicle.

Therefore, there is a need for a kit which will permit a motor vehicle to be retrofitted to accommodate a child safety seat in the middle of the backseat of the motor vehicle.

If a kit used to retrofit a motor vehicle is expensive or difficult to install, the purposes and advantages of that kit are vitiated, or may even be totally frustrated. An expensive or difficult to install kit may not be cost- or time-effective and thus will not be used.

Therefore, there is a need for a kit which will permit a motor vehicle to be retrofitted to accommodate a child safety seat in the middle of the backseat of the motor vehicle which is cost-effective and easy to install.

Still further, to be most effective, such a retrofit kit should use any seat belt system that is presently installed in a motor vehicle. This will avoid the need to remove such a system and then to replace it with a new system. Such removal and re-installation may be expensive, time-consuming and very inefficient.

Therefore, there is a need for a kit which will permit a motor vehicle to be retrofitted to accommodate a child safety seat in the middle of the backseat of the motor vehicle which can use the seat belt system that is already installed in the motor vehicle.

There are a wide variety of child safety seats on the market. Some may be more desirable for a child than others. However, if a motor vehicle cannot accommodate the most desirable seat, the advantages associated with the system used to mount a child safety seat in the motor vehicle will be vitiated.

Therefore, there is a need for a kit which will permit a motor vehicle to be retrofitted to accommodate a wide variety of child safety seats in the middle of the backseat of the motor vehicle.

PRINCIPAL OBJECTS OF THE INVENTION

It is a main object of the present invention to provide a kit which will permit a motor vehicle to be retrofitted to accommodate a child safety seat in the middle of the backseat of the motor vehicle.

It is another object of the present invention to provide a kit which will permit a motor vehicle to be retrofitted to accommodate a child safety seat in the middle of the backseat of the motor vehicle which is cost-effective and easy to install.

It is another object of the present invention to provide a kit which will permit a motor vehicle to be retrofitted to accommodate a child safety seat in the middle of the backseat of the motor vehicle and which can use the seat belt system that is already installed in the motor vehicle.

It is another object of the present invention to provide a kit which will permit a motor vehicle to be retrofitted to accommodate a wide variety of child safety seats in the middle of the backseat of the motor vehicle.

SUMMARY OF THE INVENTION

These, and other, objects are achieved by a child safety seat strap system which is retrofit onto an existing vehicle and uses the seat belt system that is already installed in the back seat of the motor vehicle. The seat belt system that is already installed generally has a lap belt formed of two portions which are releasably coupled together by a seat belt buckle. The retrofit kit included in the safety strap system embodying the present invention includes a roller device that is mounted on the back support portion of the back seat and which has a safety strap connected at one end to the roller device and which has a connector element on the other end. One portion of the already installed seat belt system is also attached to the connector element, and the connector element is releasably attached to the buckle element of the already installed seat belt system. The connector element thus connects both the safety strap and the lap belt to the buckle of the already installed seat belt system.

The safety strap system embodying the present invention makes use of the seat belt system already existing in the motor vehicle with only minor modifications being required. Thus, the system of the present invention is easy and inexpensive to install and a motor vehicle can be easily retrofit. The resulting system is very secure and can accommodate a wide variety of child safety seats. It is also noted that the motor vehicle can be any sort of land, air or water vehicle in which children may be transported.

BRIEF DESCRIPTION OF THE DRAWING FIGURES

DETAILED DESCRIPTION OF THE PREFERRED EMBODIMENT

Figure 3:
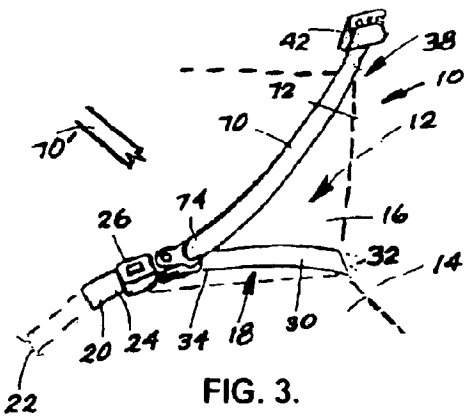
FIG. 3 shows the child safety seat strap system embodying the present invention in combination with a seat belt system already existing in a motor vehicle.

Other objects, features and advantages of the invention will become apparent from a consideration of the following detailed description and the accompanying drawings.

Referring to the Figures, it can be understood that the present invention is embodied in a child seat safety strap system 10 that can be easily placed in a motor vehicle. System 10 comprises a backseat 12 of a motor vehicle V. The backseat 12 includes a seat portion 14 and a back support portion 16. The backseat 12 further includes a seat belt system 18 which has a first lap belt 20 anchored at a first end 22 thereof to the motor vehicle and which has a second end 24 located near the seat portion 14 of the backseat 12. A seat belt buckle 26 is on the second end 24 of the first lap belt 20 of the seat belt system 18. A second lap belt 30 is anchored at a first end 32 thereof to the motor vehicle and has a second end 34.

A retrofit kit 38 is used to modify the backseat 12 of a motor vehicle to accommodate a child safety seat. The retrofit kit 38 of the present invention is used with cars that have not been manufactured to accommodate child safety seats and securely holds the safety seat in a position that meets the requirements of most, if not all, State laws concerning such safety seats. The kit 38 is inexpensive and very easy to install and thus is cost- and time-effective for an owner of an older model car.

A seat belt roller device 40 includes a housing 42 which has a first end 44, a second end 46, and a longitudinal axis 48 which extends between the first end 44 of the housing 42 and the second end 46 of the housing 42. The housing 42 further includes a first side 50, a second side 52, and a transverse axis 54 which extends between the first side 50 of the housing 42 and the second side 52 of the housing 42. A planar flange 56 is on first end 44 of the housing 42. A seat belt exit 58 is located on the housing 42 near second end 46 of the housing 42.

Figure 1:
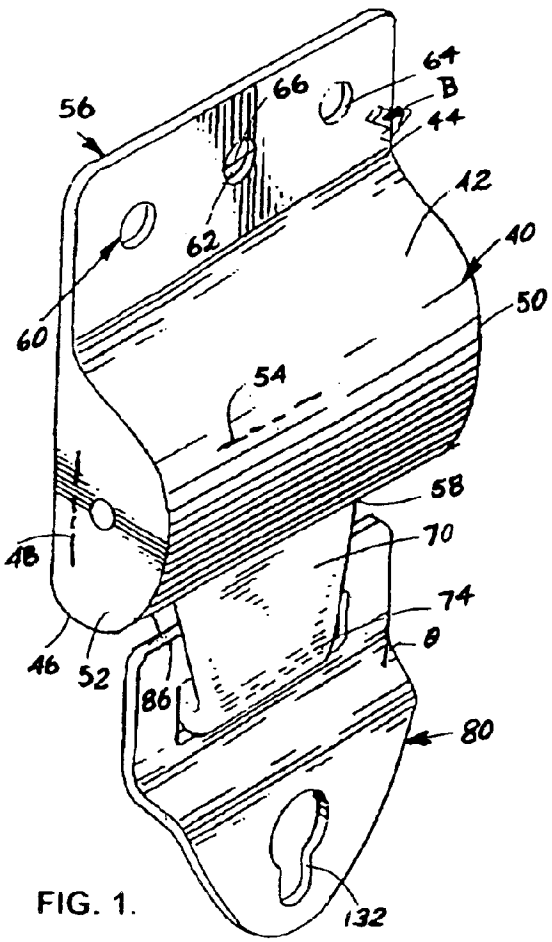
FIG. 1 is a perspective view of a seat belt roller device used in the child safety seat strap system embodying the present invention.

Three mounting bolt-accommodating holes 60, 62 and 64 are defined through the planar flange 56. The mounting bolt-accommodating holes 60, 62, 64 are spaced apart from each other in the direction of transverse axis 54 of the housing 42 of the seat belt roller device 40. Each mounting bolt-accommodating hole 60, 62, 64 has a diameter, such as diameter 66 of hole 62, that extends in the direction of the transverse axis 54 of the housing 42 of the seat belt roller device 40. The diameters of the three mounting bolt-accommodating holes 60, 62, 64 are aligned with each other. Mounting bolts, such as mounting bolt B indicated in FIG. 1, are placed through the bolt-accommodating holes 60, 62, 64 and are received in a frame member located behind the back support portion 16 of a vehicle backseat 12 to securely mount the seat belt roller device 40 on the vehicle.

As shown in FIG. 3, housing 42 of the seat belt roller device 40 is mounted on back support portion 16 of backseat 12.

A seat belt shoulder strap 70 has a first end 72 connected to the seat belt roller device 40 and a second end 74.

A one-piece monolithic Z-shaped connector element 80 includes a planar main body portion 82 which has a first side 84, a second side 86, and a transverse axis 88 which extends between the first side 84 of the main body portion 82 of the connector element 80 and the second side 86 of the main body portion 82 of the connector element 80. The connector element 80 further includes a first end 90, a second end 92, and a longitudinal axis 94 which extends between the first end 90 of the main body portion 82 of the connector element 80 and the second end 92 of the main body portion 82 of the connector element 80.

The connector element 80 further includes an offset body portion 100 on the first side 84 of the main body portion 82 of the connector element 80. The offset body portion 100 includes a first end 102 that is coplanar with the first end 90 of the main body portion 82 of the connector element 80, a second end 104 that is coplanar with the second end 92 of the main body portion 82 of the connector element 80, and a first side 106 that is spaced apart from the first side 84 of the main body portion 82 of the connector element 80. The offset body portion 100 forms an angle θ with the main body portion 82 of the connector element 80. Angle θ can be a right angle or an oblique angle.

The connector element 80 further includes a planar extension portion 110 that has a first side 112 spaced apart from first side 106 of the offset body portion 100 of the connector element 80, and a second side 114 that is connected to the first side 106 of the offset body portion 100 of the connector element 80. The planar extension 110 has a longitudinal axis 116 that extends between the first side 112 of the planar extension 110 and the second side 114 of the planar extension 110 and which extends in a plane that is parallel to a plane containing the planar main body portion 82 of the connector element 80. The planar extension element extends in the direction of the transverse axis 88 of the main body portion 82 of the connector element 80.

A handle 120 is mounted on the main body portion 82 of the connector element 80 near the first side 84 of the main body portion 82 of the connector element 80.

A belt-accommodating connector hole 130 is defined through the main body portion 82 of the connector element 80 near the second side 86 of the main body portion 82 of the connector element 80. A seat belt buckle latch accommodating hole 132 is defined through the planar extension portion 110 of the connector element 80.

As shown in FIG. 3, second end 34 of second lap belt 30 of the seat belt system 18 is connected to the body portion 82 of connector element 80 via belt-accommodating hole 130 defined through the main body portion 82 of the connector element 80 and second end 74 of seat belt shoulder strap 70 is also connected to the body portion 82 of connector element 80 via belt-accommodating hole 130 defined through the main body portion 82 of the connector element 80.

As shown in FIG. 3, the connector element 80 is releasably locked to the seat belt buckle element 26 in a use condition to releasably attach first lap belt 20 of the seat belt system 18 to second lap belt 30 of the seat belt system 18 and to second end 74 of seat belt shoulder strap 70 via the connector element 80 in a use condition of the connector element 80 and in the set up condition of the retrofit kit 38.

Figure 2:
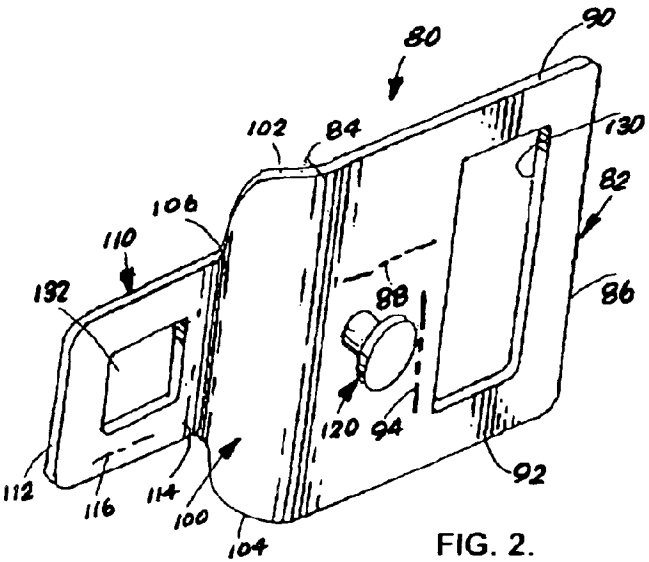
FIG. 2 is a perspective view of a connector element used in the child safety seat strap system embodying the present invention.

The belt buckle latch accommodating hole 132 is shown as a rectangular hole 132 in FIG. 2, but other shapes, including a keyhole-shaped hole 132' as shown in FIG. 1, can be used. It is also noted that while one shoulder strap 70 is shown in FIG. 2, two shoulder straps can also be used in a criss cross fashion, as indicated in FIG. 2, with a second shoulder strap 70' being identical to shoulder strap 70 and having a second end also connected to the connector element 80 via hole 130 so a child safety seat can be anchored to the backseat 12 of a vehicle using two crossing straps and the connector element 80 releasably connecting the crossing straps to the lap belts 20, 30 as above described.

System 10 is easily mounted by simply mounting the seat belt roller device 40 on the backseat 12 of the motor vehicle, and connecting both the shoulder strap 70 and the lap belt 30 to the connector element 80. A child safety seat can then be anchored by extending the lap belts 20, 30 and the shoulder strap 70 around the safety seat.

It is understood that while certain forms of the present invention have been illustrated and described herein, it is not to be limited to the specific forms or arrangements of parts described and shown.

What is claimed and desired to be covered by Letters Patent is:

1. A child seat safety strap system comprising:

a) a backseat of a motor vehicle which includes (1) a seat portion, (2) a back support portion, (3) a seat belt system which has (A) a first lap belt anchored at one end thereof to the motor vehicle and having a second end located near the seat portion of said backseat, (B) a seat belt buckle on the second end of the first lap belt of the seat belt system of said backseat, and (C) a second lap belt anchored at one end thereof to the motor vehicle and having a second end; and b) a retrofit kit which includes (1) a seat belt roller device which includes (2) a housing having a first end, a second end, a longitudinal axis extending between the first end of the housing and the second end of the housing, a first side, a second side, a transverse axis extending between the first side of the housing and the second side of the housing, (3) a planar flange on the first end of the housing, (4) a seat belt exit on the housing near the second end of the housing, (5) three mounting bolt-accommodating holes defined through the planar flange, the mounting bolt-accommodating holes being spaced apart from each other in the direction of the transverse axis of the housing of said seat belt roller device, each mounting bolt-accommodating hole having a diameter that extends in the direction of the transverse axis of the housing of said seat belt roller device, the diameters of the three mounting bolt-accommodating holes being aligned with each other, (6) the housing of said seat belt roller device being mounted on the back support portion of said backseat, (7) a seat belt shoulder strap having a first end connected to said seat belt roller device and a second end, (8) a one-piece monolithic Z-shaped connector element which includes (A) a planar main body portion having a first side, a second side, a transverse axis extending between the first side of the main body portion of said connector element and the second side of the main body portion of said connector element, a first end, a second end, a longitudinal axis extending between the first end of the main body portion of said connector element and the second end of the main body portion of said connector element, (B) an offset body portion on the first side of the main body portion of said connector element, the offset body portion including a first end that is coplanar with the first end of the main body portion of said connector element, a second end that is is coplanar with the second end of the main body portion of said connector element, a first side that is spaced apart from the first side of the main body portion of said connector element, the offset body portion forming an angle with the main body portion of said connector element, (C) a planar extension portion that has a first side spaced apart from the first side of the offset body portion of said connector element, a second side that is connected to the first side of the offset body portion of said connector element, the planar extension having a longitudinal axis that extends between the first side of the planar extension and the second side of the planar extension and which extends in a plane that is parallel to a plane containing the planar main body portion of said connector element and which extends in the direction of the longitudinal axis of the main body portion of said connector element, (D) a handle mounted on the main body portion of said connector element near the first side of the main body portion of said connector element, (E) a belt-accommodating connector hole defined through the main body portion of said connector element near the second side of the main body portion of said connector element, and (F) a seat belt buckle latch accommodating hole defined through the planar extension portion of said connector element;

(9) the second end of the second lap belt of said seat belt system of said backseat being connected to the body portion of the connector element via the belt-accommodating hole defined through the main body portion of said connector element and the second end of said seat belt shoulder strap also being connected to the body portion of the connector element via the belt-accommodating hole defined through the main body portion of said connector element in a set up condition of said retrofit kit, and

(10) said connector element being releasably locked to the seat belt buckle element to releasably attach the first lap belt of said seat belt system of said backseat to the second lap belt of said seat belt system of said backseat and to the second end of said seat belt shoulder strap via said connector element in a use condition of said connector element and in the set up condition of said retrofit kit.

* * * * *